United States Patent [19]

Boujet

[11] 4,155,058

[45] May 15, 1979

[54] MILLIMETRIC WAVE HIGH-PASS FILTER

[75] Inventor: Jean-Pierre Boujet, Chatillon, France

[73] Assignee: Compagnie Industrielle des Telecommunications Cit-Alcatel, Paris, France

[21] Appl. No.: 813,511

[22] Filed: Jul. 7, 1977

[30] Foreign Application Priority Data

Jul. 27, 1976 [FR] France ..... 76 22842

[51] Int. Cl.[2] ..... H01P 1/20; H01P 5/18

[52] U.S. Cl. ..... 333/208; 333/109

[58] Field of Search ..... 333/10, 73 R, 73 C, 333/73 S, 73 W

[56] References Cited

U.S. PATENT DOCUMENTS 3,851,282 11/1974 Watson ..... 333/73 W

FOREIGN PATENT DOCUMENTS 1395638 5/1975 United Kingdom ..... 333/73 W

OTHER PUBLICATIONS

IEEE Trans, MTT-22, No. 2, Feb.-1974, Shimada et al., "Semicircular Waveguide-Type Diplexers Used for the Millimeter-Wave Waveguide Transmission System."

*Primary Examiner*—Alfred E. Smith
*Assistant Examiner*—Harry E. Barlow
*Attorney, Agent, or Firm*—Roland Plottel

[57] ABSTRACT

A millimetric wave high-pass filter is assembled from two axially-separate halves. Each half comprises a cast metal body having a channel which is divided to form two wave guides by means of a metal strip. The dimensions of the wave guides of the filter as a whole decrease towards a constriction at their centers while the strip is relatively thick at the constriction and tapers towards the ends. This configuration makes it possible to cast the filter in two halves with the body and the strip of each half being cast in a single piece. When assembled the halves meet at the level of the constriction.

4 Claims, 5 Drawing Figures

FIG.1a
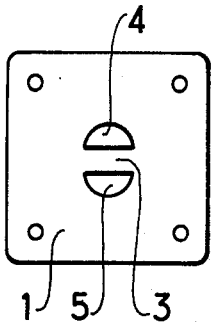
FIG.1b
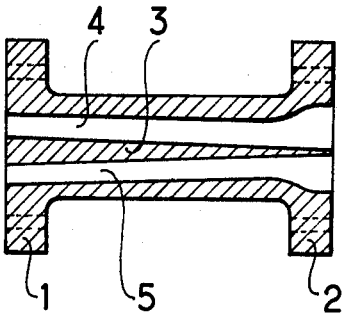
FIG.1c
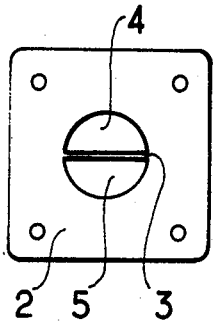
FIG.2
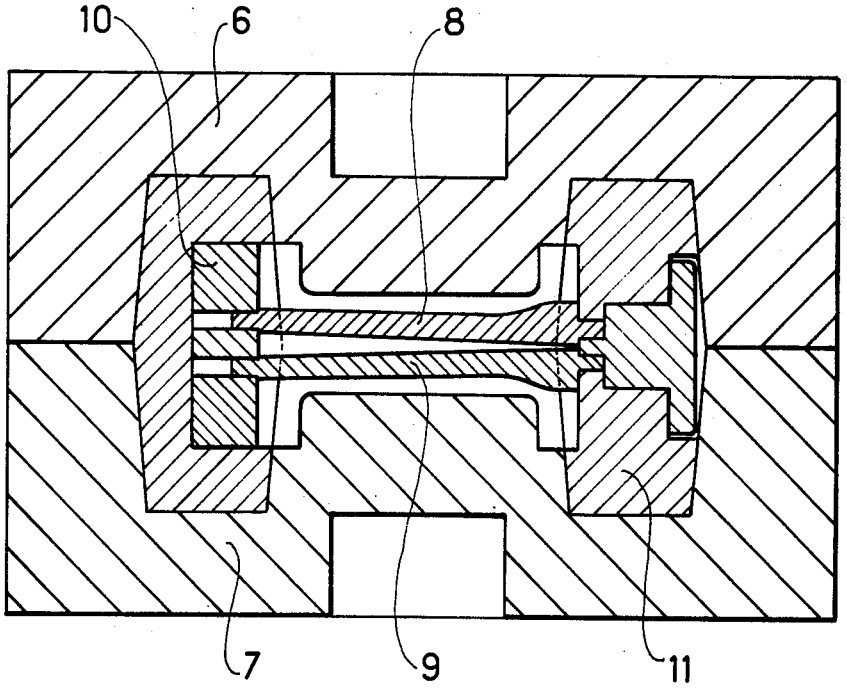
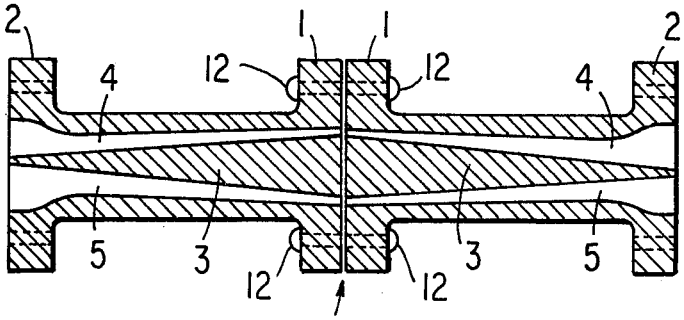
FIG.1d

MILLIMETRIC WAVE HIGH-PASS FILTER

The invention relates to a method of manufacturing a millimetric wave high-pass filter and to filters manufactured according to the method.

Microwave filters are constituted by a length of wave guide of reduced cross-sectional area which pass only those high frequencies which are above a cut-off frequency. For low frequencies, such a filter acts as a short circuit and reflects all the energy back towards the inlet.

High-pass cut off filters can be found in the form of rectangular wave guides, of circular wave guides, of semi-circular wave guides or of mixed wave guides.

A filter of the double wave guide type is constituted by two wave guides, e.g. semi-circular, coupled together in a metal body which has a wave guide channel that is divided in two by a metal strip. Such a filter can be used, for example, in a diplexer such as is described in French patent application No. 73 34 997 published under the number 2246 089 in combination with semi-circular couplers at its inlet and outlet. The metal strip which separates the wave guides of such couplers and which includes the coupling holes is very thin. To connect such couplers to a semi-circular double wave guide type of filter, the thickness of the strip at the inlet to the filter must be identical to the thickness of the coupler's strip.

There are known methods of manufacturing such a filter based on electrodeposition of copper on a suitably shaped mandrel. After a sufficiently thick layer of copper has been formed, the mandrel is dissolved. There is no other way of removing it, because of the constricted shape of the filter. This method is relatively expensive since mandrels of a very precise shape are necessary and they can only be used once. However, filters obtained in this way have a very good electrical performance and a low transmission loss, of about 0.1 dB.

A method of manufacturing such a filter by moulding appears to be unattractive since the moulding of the thin strip is a very delicate operation and the mandrel or the core must be chemically dissolved, and cannot be used again. It is conceivable that two shells could first be moulded, and then assembled with a central strip. Such a method would enable a single mould to be re-used and would provide filters with very thin strips. But the transmission losses of such a filter are noticeably larger than in the preceding case because of the mechanical and electrical non-continuity at the angles of the semi-circular wave guides. Particularly since it is known, in a semi-circular high-pass filter, that these guides constitute zones of high electromagnetic current, higher than in a constant radius semi-circular wave guide (e.g. a coupler).

An object of the invention is thus to provide a high-pass filter of the said double wave guide type with a low manufacturing cost and whose electrical characteristics are excellent.

This object can be achieved by the method of the present invention of manufacturing a millimetric wave high-pass filter of the double wave guide type, i.e., a filter comprising a metal body having a channel which is divided by a metal strip to form two wave guides, the bores of the guides having dimensions which decrease going from each of the ends of the guides towards their centres, the method comprising the steps of: firstly providing a mould for one half of the filter, where the plane of separation between the halves is substantially perpendicular to the axes of the guides: secondly inserting into the mould two cores to define the bores of the two guides, where the guides are separated by a distance which decreases going from the separation plane to the end of the filter; thirdly casting molten metal into the mould; fourthly removing both the cores from the mould after the metal has solidified; and finally, assembling two filter halves thus moulded to constitute the filter.

The invention also relates to the filter thus obtained, which is characterised by the fact that it is composed of two halves whose plane of joining is substantially perpendicular to the axes of the wave guides, and at a corresponding extremity of each filter half and that the metal strip is an integral part of the metal bodies, its thickness decreasing going from the said plane to the ends.

The invention is further described below by way of example, with reference to the accompanying drawing in which:

FIGS. 1*a*, 1*b* and 1*c* show respectively a first end view, a cross-section and a second end view of one half of a filter embodying the invention;

FIG. 1*d* shows the manner in which two filter halves of the type shown in FIG. 1*b* may be assembled to form a composite filter; and FIG. 2 shows the mould which is used in the method of the invention.

FIG. 1*b* shows a cross-section of a double semi-circular wave guide type of filter embodying the invention. Each half of the filter has respective flanges 1 and 2 at its ends; the flange 1 is for joining the two halves of the filter together, and the flange 2 is for joining to any other element of a wave guide circuit in which the filter in question is to be inserted.

The half of the filter shown in FIG. 1*b* is in a single piece, it is made in a mould as shown in FIG. 2 as is explained below. A characteristic of the filter of the invention is that the thickness of the central strip 3 (which strip constitutes the base of both of the semi-circular wave guides 4 and 5) increases from the end flange 2 to the join flange 1. The radius of both of the guides, which are of identical shape, decreases from the flange 2 to the flange 1 according to a well known relationship to ensure a low standing wave ratio between the flange 2 and the flange 1. FIG. 1*a* shows the front of the flange 1 and the semi-circular wave guides 4 and 5. The end flange 2 is shown in a front view in FIG. 1*c*.

The thickness of the central strip increases from 0.2 mm, corresponding to the thickness of the strips of the couplers, to 4 mm at the plane of joining between filter halves. Because of the increased thickness of the strip the metal spreads well between the cores during casting. Because of the division of the filter in the middle of the constriction, the cores are easily extracted after casting since they are of constant taper and the central strip is less fragile than a conventional thin strip.

FIG. 1*d* depicts the manner in which two filter halves of the type shown in FIG. 1*b* are assembled to form the complete double semi-circular wave guide filter discussed above. As shown, the two flanges 1 of each half are abutted and firmly secured, one to the other, by means of machine screws 12—12.

FIG. 2 shows a cross-section of a mould in which a half such as shown in FIG. 1*b* is moulded. The mould is constituted by two shells 6 and 7 which define the external shape of the filter. Two cores 8 and 9 are fixed inside the shells between two fixing heads 10 and 11, one at each end. The heads are kept in place in corresponding cavities provided in the shells. Both the cores are of identical shape and they define the interior shape of the semi-circular wave guides in the filter half under consideration.

The method of the invention thus includes the steps of: providing such a mould; casting molten metal into the mould; allowing the metal to cool; opening the shells; removing the two fixing heads 10 and 11 and then extracting the cores (towards the right in FIG. 2). The cores can thus be re-used, for example to manufacture the second half of the same filter. It is also evident that, simply by exchanging of the cores, it is possible to modify the radii of the guides and thus make filters whose inlet radii differ from their outlet radii. Since the cores are not destroyed after each casting, filters made in this way are notable for highly accurate reproducibility. It is also to be noted that the flanges are made at the same time, which is not the case for the electro-deposition method.

The electromagnetic currents of the guide are less hindered by poor contact when the filter is divided along a plane which is perpendicular to the axis of the filter than when it is divided along a plane which includes the axis.

The joining of two halves, such as shown in FIG. 1*b*, causes a discontinuity in the guides, but the plane of this semi-circular discontinuity is such that it does not generate parasitic modes provided that the radius is such that the TE12 and TE22 modes are generated outside the useful band.

By way of example the dimensions of a filter according to the invention are given below. The cut-off frequency is 38.75 GHz :

Inlet radius 8.2 mm; outlet radius 6.75 mm; radius at the level of the separation plane 4.74 mm; thickness of the strip at its ends 0.2 mm; thickness of the strip at the separation plane 4 mm; and transmission loss 0.1 dB.

It has been observed that sufficient accuracy can be obtained to avoid the need for machining the surfaces of the guides after moulding, simply by means of low pressure casting with an aluminium alloy having 7% silicon.

Although the invention has been described by way of an example having two semi-circular guides, the invention is in no way limited to this example. Without going beyond the scope of the invention, it is possible to devise filters whose guides are of rectangular or of circular section or whose guides are of different types.

What we claim is:

1. A millimetric wave high-pass filter comprising an assembly of two half filters, each half filter comprising a metal body having a channel which is divided into two wave guides by a metal strip which is integral with the body, the bores of the guides having dimensions which decrease going from each of the ends of the guides towards their centres, the two halves of the filter meeting each other, when assembled, at a plane of joining which is substantially perpendicular to the axes of the wave guides and at a corresponding extremity of each filter half and the metal strips being of a thickness which decreases from the plane of joining to the opposite end of the strip.

2. A filter according to claim 1 wherein each half has an access end flange integrally moulded with the body.

3. A filter according to claim 1 wherein each half has an assembly flange which is moulded integrally with the body and which has one surface lying in the plane of joining in contact with the facing access flange of the other half when the two halves are assembled.

4. A filter according to claim 1 wherein both the wave guides are semi-circular guides of identical dimensions.

* * * * *